US008006618B2

(12) United States Patent
Gsell et al.

(10) Patent No.: US 8,006,618 B2
(45) Date of Patent: Aug. 30, 2011

(54) DEVICE AND METHOD FOR PERFORMING A PRINTING PLATE CHANGE ON A PLATE CYLINDER OF A PRINTING PRESS

(75) Inventors: Thomas Gsell, Dillingen (DE); Rudolf Stroh, Duernau (DE); Thomas Boeck, Neusaess (DE); Wolfgang Kaeser, Mertingen (DE)

(73) Assignee: MAN Roland Druckmaschinen AG, Augsburg (DE)

( * ) Notice: Subject to any disclaimer, the term of this patent is extended or adjusted under 35 U.S.C. 154(b) by 762 days.

(21) Appl. No.: 11/957,336

(22) Filed: Dec. 14, 2007

(65) Prior Publication Data

US 2008/0156214 A1 Jul. 3, 2008

(30) Foreign Application Priority Data

Dec. 15, 2006 (DE) ..... 10 2006 059 772

(51) Int. Cl.
*B41F 27/12* (2006.01)

(52) U.S. Cl. ..... 101/477; 101/415.1; 101/486

(58) Field of Classification Search ..... 101/477, 101/480, 481, 485, 486, 216, 415.1
See application file for complete search history.

(56) References Cited

U.S. PATENT DOCUMENTS

| | | | | |
|---|---|---|---|---|
| 5,806,431 | A * | 9/1998 | Muth | 101/486 |
| 6,199,280 | B1 * | 3/2001 | Schneider et al. | 29/895.211 |
| 6,396,272 | B1 * | 5/2002 | Dietz et al. | 324/318 |
| 6,792,860 | B2 * | 9/2004 | Schroder et al. | 101/477 |
| 7,237,484 | B2 * | 7/2007 | Weschenfelder et al. | 101/477 |
| 7,647,868 | B2 * | 1/2010 | Schneider et al. | 101/477 |
| 2006/0273530 | A1 * | 12/2006 | Zuber | 280/5.52 |

FOREIGN PATENT DOCUMENTS

| | | | |
|---|---|---|---|
| DE | 42 31 901 | C2 | 3/1994 |
| DE | 44 40 239 | C2 | 5/1996 |
| DE | 10 2004 022 083 | B3 | 10/2005 |
| EP | 1 453 677 | B1 | 9/2004 |
| WO | WO 94/06631 | | 3/1994 |
| WO | WO 2005/110755 | A1 | 11/2005 |

* cited by examiner

*Primary Examiner* — Ren Yan
(74) *Attorney, Agent, or Firm* — Crowell & Moring LLP

(57) ABSTRACT

A device and method for performing a printing plate change on a plate cylinder of a printing press is disclosed. The device includes a rolling element featuring several rollers for pressing at least one printing plate on the plate cylinder during a printing plate change. A strip bearing several alignment elements extends parallel to the rolling element, where a printing plate can be aligned true-to-register between every two adjacent alignment elements before the printing plate is clamped in a lockup slot of the plate cylinder.

8 Claims, 3 Drawing Sheets

DEVICE AND METHOD FOR PERFORMING A PRINTING PLATE CHANGE ON A PLATE CYLINDER OF A PRINTING PRESS

This application claims the priority of German Patent Document No. 10 2006 059 772.9, filed Dec. 15, 2006, the disclosure of which is expressly incorporated by reference herein.

BACKGROUND AND SUMMARY OF THE INVENTION

The invention relates to a device and method for performing a printing plate change on a plate cylinder of a printing press.

German Patent Document No. DE 44 40 239 C2 discloses a device embodied as a rolling element for performing a printing plate change on a plate cylinder of a printing press. The rolling element disclosed there is used when changing the printing plate to press a flexible printing plate on the plate cylinder of a printing couple of a printing press. The rolling element in accordance with DE 44 40 239 C2 has several rollers that can be individually engaged on the plate cylinder that are arranged in the longitudinal direction of the plate cylinder, wherein at least one first roller can be engaged when mounting the printing plate and at least one second roller can be engaged when dismounting the printing plate in the region of the printing plate on the plate cylinder. It is possible with the rolling element in accordance with DE 44 40 239 C2 to precisely press the printing plate on the plate cylinder when changing the printing plates, but the device in accordance with the prior art does not permit precise alignment of the printing plate relative to the plate cylinder.

A device for performing a printing plate change on a plate cylinder of a printing press is known from German Patent Document No. DE 10 2004 022 083 B3, which features an alignment element on each of the two sides of the rolling element featuring several rollers in order to align a to-be-clamped printing plate relative to the plate cylinder when changing a printing plate. In this case, the alignment elements have a gripper and a clamping piece cooperating with the gripper, whereby a to-be-clamped printing plate can be clamped between the gripper and the clamping piece.

Starting from here, the present invention is based on the objective of creating a novel device and method for performing a printing plate change on a plate cylinder of a printing press.

According to the invention, a strip bearing several alignment elements extends parallel to the rolling element, wherein a printing plate can be aligned true to register between every two adjacent alignment elements before the printing plate is clamped in a lockup slot of the plate cylinder.

With the inventive device and method, it is possible to simultaneously align several printing plates true to register relative to the plate cylinder before the printing plates are clamped on the plate cylinder. In addition, the device in accordance with the invention is structurally simple and can be realized at a relatively low cost.

At least two centering pins are preferably allocated to the strip, which is upstream from the rolling element, and these pins can be inserted into corresponding recesses of the plate cylinder to align the strip and therefore the alignment elements relative to the plate cylinder.

According to an advantageous development of the invention, clamping elements extend between adjacent alignment elements, wherein a printing plate, which is to be clamped in the lockup slot of the plate cylinder and which is to be aligned true to register on the corresponding alignment elements, can be held down by each clamping element during a printing plate change.

When the strip and therefore the alignment elements are aligned relative to the plate cylinder for the printing plate change, a lower edge of the clamping elements is at a distance from a surface of the plate cylinder that is greater than the thickness of a printing plate so that a printing plate can be fed between a clamping element and the plate cylinder and can be moved in the direction towards the corresponding alignment elements, and a lower edge of the strip is at a distance from a surface of the plate cylinder that is less than the thickness of the printing plate so that the printing plate cannot be fed between the strip and the plate cylinder.

Preferred developments of the invention are yielded from the following description. Without being limited hereto, one exemplary embodiment of the invention is explained in greater detail on the basis of the drawings.

DETAILED DESCRIPTION OF THE DRAWINGS

Figure 1:
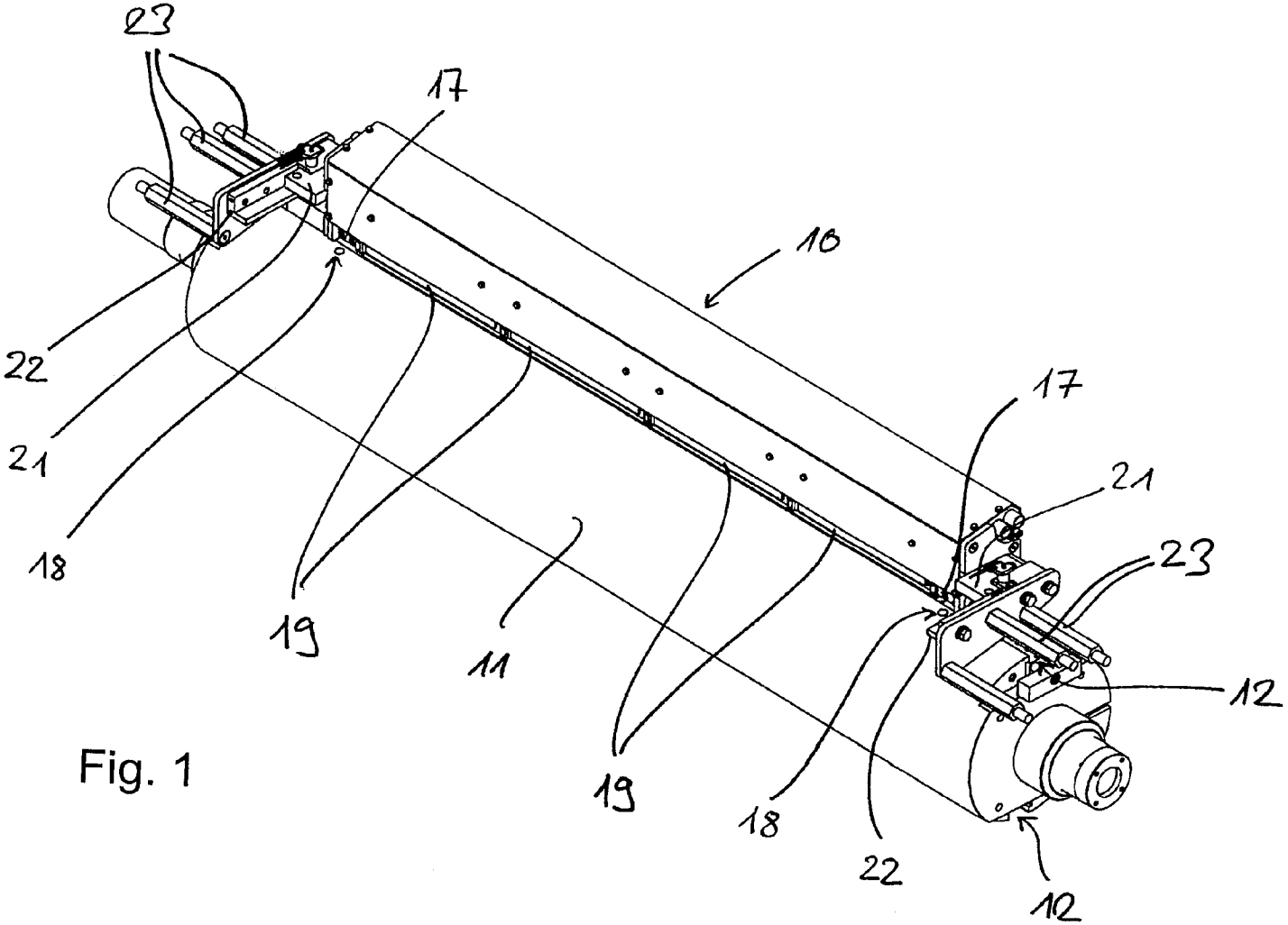
FIG. 1 is a perspective view from above of a device in accordance with the invention for performing a printing plate change on a plate cylinder of a printing press together with a plate cylinder.
Figure 2:
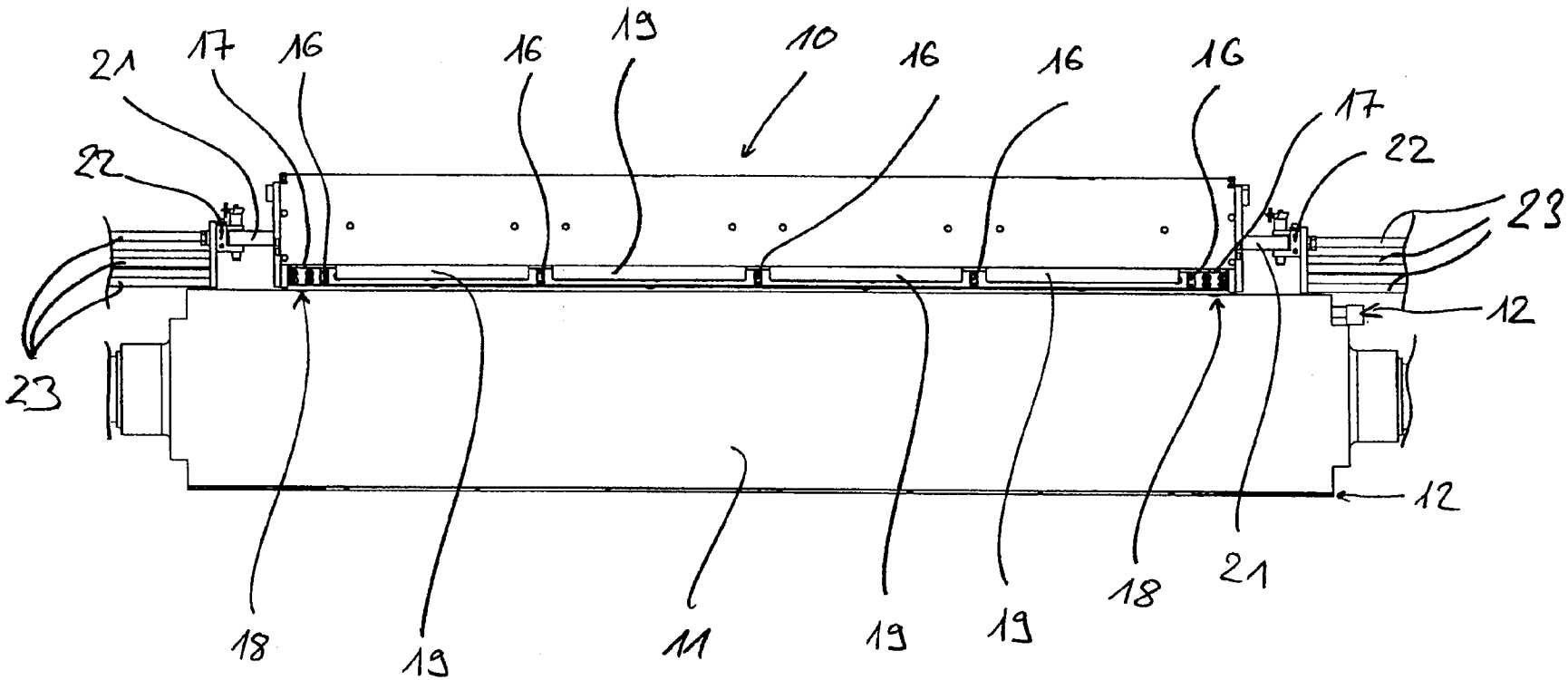
FIG. 2 is a front view of the arrangement in FIG. 1.
Figure 3:
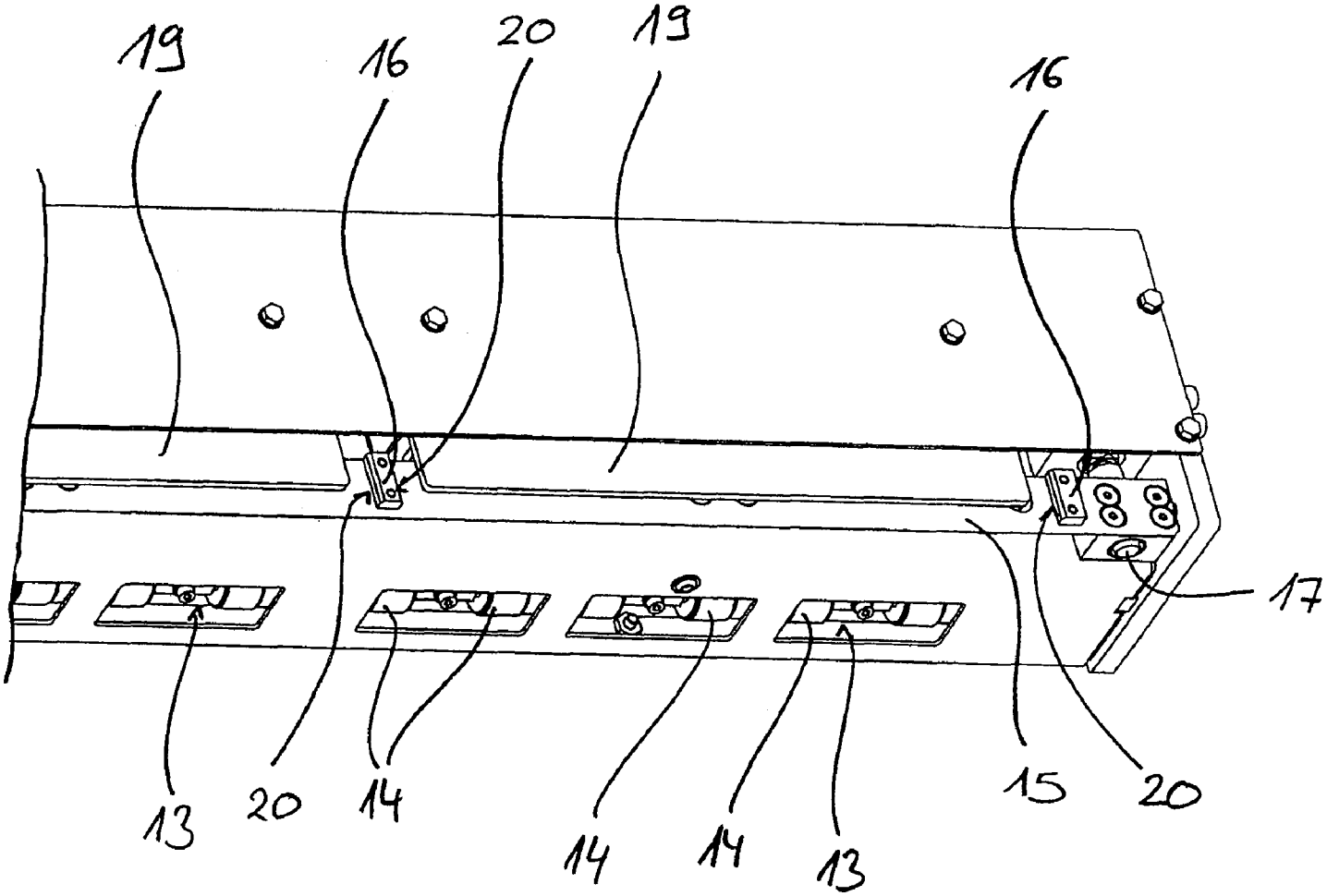
FIG. 3 is a perspective view from below of a section of the device in FIG. 1.

FIGS. 1 through 3 show different views of an inventive device 10 for performing a printing plate change on a plate cylinder of a printing press, wherein FIGS. 1 and 2 show the inventive device 10 together with a plate cylinder 11.

In the depicted exemplary embodiment, the plate cylinder 11 has a lockup slot 12 (see FIG. 1) on each of two essentially diametrically opposed sections in order to successively clamp two printing plates on the plate cylinder as seen in the circumferential direction of the plate cylinder 11. In the exemplary embodiment shown, the plate cylinder 11 has an axial width, which makes it possible to clamp four printing plates side by side as seen in the axial direction of the plate cylinder 11. The plate cylinder depicted in FIGS. 1 and 2 is consequently embodied as a so-called 4/2 plate cylinder; therefore, four printing plates can be clamped side by side on the plate cylinder as seen in the axial direction and two printing plates can be clamped successively on the plate cylinder as seen in the circumferential direction.

The device 10 in accordance with the invention has a rolling element 13 (see FIG. 3), whereby the rolling element 13 features several rollers 14, which are used to press the to-be-clamped printing plates on the plate cylinder 11 when a printing plate is being changed. The embodiment of this type of rolling element 13 is familiar to those skilled in the art being addressed here and requires no further explanation.

In addition to the rolling element 13, the inventive device 10 has a strip 15 extending parallel to the rolling element 13, wherein the strip 15 bears several alignment elements 16. According to FIG. 2, the strip 15 in the depicted exemplary embodiment bears a total of five alignment elements 16. A printing plate can be aligned true to register relative to the plate cylinder 11 between every two adjacent alignment elements 16 before the printing plate is clamped in a lockup slot 12 of the plate cylinder 11. In this case, the strip 15 bearing the several alignment elements 16 is upstream from the rolling element 13.

In the depicted exemplary embodiment, a centering pin 17 is allocated to each end of the strip 15. The centering pins 17 are used to align the strip 15 and thus the alignment elements 16 relative to the plate cylinder 11, wherein the centering pins 17 can be inserted into corresponding recesses 18 of the plate cylinder 11 for this purpose.

Along with the rolling element 13 and the strip 15 bearing the alignment elements 16, the inventive device 10 also features clamping elements 19. A clamping element 19 extends between each two adjacent alignment elements 16, wherein a printing plate, which is to be aligned true to register on the corresponding alignment elements 16, can be held down by each clamping element 19 during a printing plate change.

When the device 10 is aligned relative to the plate cylinder 11 via the centering pins 17 allocated to the strip 15, a lower edge of the clamping elements 19 is at a distance from a surface of the plate cylinder 11 that is greater than the thickness of a printing plate so that a printing plate can be fed between a clamping element 19 and the plate cylinder 11 and can be moved in the direction towards the alignment elements 16 positioned laterally next to the respective clamping element 19. In this case, a lower edge of the strip 15 is at a distance from the surface of the plate cylinder that is less than the thickness of the printing plate so that the printing plate cannot be fed between the strip 15 and the plate cylinder 11.

In the depicted exemplary embodiment, the alignment elements 16 are embodied as rectangular blocks. The side walls 20 (see FIG. 3 in particular) being used for the true-to-register alignment of a printing plate feature a phase, via which a printing plate can be aligned true to register.

The side walls 20 being used for the true-to-register alignment of a printing plate are divided in this case preferably into two sections according to FIG. 3, namely into a first chamfered section and a second unchamfered section. The first chamfered sections of the side walls 20 protrude into the projection opposite from a lockup slot of the plate cylinder 11 and the second unchamfered sections of the side walls 20, on the other hand, fall into the projection in the lockup slot of the plate cylinder 11.

After being aligned on the first, chamfered sections of the side walls 20, when a printing plate arrives in the area of the second unchamfered sections of the side walls 20 of the alignment elements 16, the printing plate in a true-to-register state can engage with one end of the printing plate in the corresponding lockup slot of the plate cylinder 11 and be clamped in the plate cylinder. To clamp a printing plate in a lockup slot, a clamping device is integrated into the lockup slot; the clamping device is familiar to those skilled in the art being addressed here and requires no further explanation.

The alignment elements 16 are embodied preferably as peizoelements. These types of peizoelements can be adapted and/or changed in terms of their external form or geometry in a controlled manner by a central control console in order to thereby guarantee a register adaptation that minimizes the so-called fan-out effect.

According to FIGS. 1 and 2, the device 10 in accordance with the invention is fixed on bent fastening elements 22 via support elements 21, which are positioned on both sides of the device 10, wherein the device 10 is fastened/or positioned on a frame of the printing press via braces 23 engaging on the fastening elements 22.

LIST OF REFERENCE NUMERALS

10 Device
11 Plate cylinder
12 Lockup slot
13 Rolling element
14 Roller
15 Strip
16 Alignment element
17 Centering pin
18 Recess
19 Clamping element
20 Side wall
21 Support element
22 Fastening element
23 Brace The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A printing press, comprising:

a plate cylinder including a lockup slot; and a printing plate changing device including a rolling element featuring several rollers for pressing a printing plate on the plate cylinder during a printing plate change, a strip bearing several alignment elements that extends parallel to the rolling element, wherein a printing plate is alignable true-to-register between every two adjacent alignment elements, and at least two centering pins allocated to the strip which are insertable into corresponding recesses of the plate cylinder to align the strip and therefore the alignment elements relative to the plate cylinder.

2. The printing press according to claim 1, wherein clamping elements extend between adjacent alignment elements, wherein a printing plate, which is to be clamped in the lockup slot of the plate cylinder and which is to be aligned true-to-register on the corresponding alignment elements, is holdable down by each clamping element during a printing plate change.

3. The printing press according to claim 2, wherein when the strip and therefore the alignment elements are aligned relative to the plate cylinder for the printing plate change, a lower edge of the clamping elements is at a distance from a surface of the plate cylinder that is greater than a thickness of a printing plate so that a printing plate is feedable between a clamping element and the plate cylinder and is moveable in a direction towards the corresponding alignment elements, and a lower edge of the strip is at a distance from the surface of the plate cylinder that is less than the thickness of the printing plate so that the printing plate cannot be fed between the strip and the plate cylinder.

4. The printing press according to claim 1, wherein the strip bearing the several alignment elements is upstream from the rolling element.

5. A printing press, comprising:

a plate cylinder including a lockup slot; and a printing plate changing device including a rolling element featuring several rollers for pressing a printing plate on the plate cylinder during a printing plate change, a strip bearing several alignment elements that extends parallel to the rolling element, wherein a printing plate is alignable true-to-register between every two adjacent alignment elements, wherein the alignment elements feature a phase on side walls being used for the true-to-register alignment of the printing plate, and wherein the side walls of the alignment elements being used for the true-to-register alignment of the printing plate are divided into two sections, namely into a first chamfered section and a second unchamfered section, wherein the first chamfered section protrudes into a projection opposite from the lockup slot of the plate cylinder and the second unchamfered section falls into a projection in the lockup slot of the plate cylinder.

6. A printing press, comprising:

a plate cylinder including a lockup slot; and a printing plate changing device including:

a strip including a first alignment element and a second alignment element;

a first centering pin disposed at a first end of the strip and a second centering pin disposed at a second end of the strip;

a plurality of rollers disposed within the strip and between the first and second alignment elements; and a clamping element coupled to the strip and disposed between the first and second alignment elements;

wherein the first and second centering pins are insertable into corresponding recesses of the plate cylinder to align the strip and the first and second alignment elements relative to the plate cylinder.

7. The printing press according to claim 6, wherein the first and second alignment elements are configured as a rectangular block.

8. The printing press according to claim 7, wherein the rectangular block includes a first chamfered section and a second unchamfered section and wherein the first chamfered section protrudes into a projection opposite from the lockup slot of the plate cylinder and the second unchamfered section falls into a projection in the lockup slot of the plate cylinder.

* * * * *